United States Patent [19]
Barrat et al.
[11] 4,448,699
[45] May 15, 1984

[54] LAUNDRY ADDITIVE PRODUCTS CONTAINING AMINO-SILANES

[75] Inventors: Christian R. Barrat; John R. Walker, both of Brussels; Jean Wevers, Strombeek-Bever, all of Belgium

[73] Assignee: The Procter & Gamble Company, Cincinnati, Ohio

[21] Appl. No.: 421,186

[22] Filed: Sep. 22, 1982

[30] Foreign Application Priority Data

Sep. 25, 1981 [GB] United Kingdom ..... 8129068
Nov. 27, 1981 [GB] United Kingdom ..... 8135945

[51] Int. Cl.[3] ..... D06M 13/38; C11D 7/32
[52] U.S. Cl. ..... 252/8.75; 252/8.6; 252/8.8; 252/8.9; 252/91; 252/95; 252/174.21; 252/389 R; 428/289
[58] Field of Search ..... 428/289, 447; 252/91, 252/95, 8.6, 8.8; 427/242

[56] References Cited

U.S. PATENT DOCUMENTS

| | | | |
|---|---|---|---|
| 2,971,864 | 2/1961 | Speier | 427/388 |
| 2,972,598 | 2/1961 | Morehouse | 260/46.5 |
| 3,033,815 | 5/1962 | Pike et al. | 260/46.5 |
| 3,085,908 | 4/1963 | Morehouse et al. | 427/388 R X |
| 3,175,921 | 3/1965 | Hedlund | 427/409 |
| 3,876,459 | 4/1975 | Burrill | 8/127.6 X |
| 4,005,025 | 1/1977 | Kinstedt | 252/547 X |
| 4,005,118 | 1/1977 | Heckert et al. | 252/546 |
| 4,062,999 | 12/1977 | Kondo et al. | 428/391 |
| 4,137,179 | 1/1979 | Koerner et al. | 252/8.6 |
| 4,152,273 | 5/1979 | Weiland | 252/8.8 |
| 4,304,562 | 12/1981 | Bolan et al. | 8/137 |
| 4,352,917 | 10/1982 | Tripp | 528/26 |

FOREIGN PATENT DOCUMENTS

| | | |
|---|---|---|
| 753603 | 2/1967 | Canada . |
| 1793280 | 2/1972 | Fed. Rep. of Germany . |
| 1207724 | 2/1960 | France . |
| 2299447 | 2/1960 | France . |
| 858445 | 1/1961 | United Kingdom . |

*Primary Examiner*—P. E. Willis, Jr.
*Attorney, Agent, or Firm*—Donald E. Hasse; Robert B. Aylor; Thomas H. O'Flaherty

[57] ABSTRACT

Laundry additive products having improved machine compatibility containing specific amino-silanes. A preferred execution of the technology is a combination of a flexible substrate and the amino-silane. The claimed additives provide enhanced machine protection especially in relation to enamel coated surfaces.

11 Claims, No Drawings

LAUNDRY ADDITIVE PRODUCTS CONTAINING AMINO-SILANES

FIELD OF THE INVENTION

This invention relates to laundry additive products having improved compatibility with washing and drying machines and especially to machines incorporating enamel-coated surfaces. More particularly, it relates to laundry additive products incorporating a specific amino-silane in combination with a flexible non particulate substrate. Preferably, the silane-substrate combination is perfected through the addition of substances having known detergent functionalities such as surface-active agents.

BACKGROUND OF THE INVENTION

Over the past decade there has been a trend towards the use of lower temperatures in domestic fabric laundering, arising from the increased incidence of coloured fabrics, the greater use of synthetic fibres in fabric manufacture and the need to conserve energy. This trend has in turn led to the development of concentrated liquid detergent formulations for laundry use, because this product form is better adapted to low temperature usage. At the present time, granular detergent compositions are not totally satisfactory for use under cold water washing conditions because of weaknesses in the areas of dissolving speed, product insolubility, and consequently cleaning efficiency.

The formulation flexibility for liquid detergent compositions is limited, particularly in respect to inorganic materials such as silicates. The latter compound is essential, in solid detergents, to ensure adequate compatibility of the laundry liquor with the washing machine, in particular with enamel-coated surfaces. To date, no suitable silicate-substitutes for convenient use in liquid detergent compositions have been developed and an unfulfilled need exists for such materials. A satisfactory substitute should exhibit its functionality not solely at relatively high alkaline pH such as needed by silicates, but over a broad range of conditions extending from e.g. neutral to alkaline (pH 6–12) conditions such as are found in liquid detergents. The silicate-substitute should furthermore be compatible with the physical state of the matrix, it must allow the preparation of homogeneous compositions and it should also be compatible with individual ingredients and not be subject to deactivation/precipitation phenomena.

Silanes and amino-silanes are widely used in the chemical industry, mostly as coupling agents between inorganic and organic surfaces. These compounds have also found application for metal-surface protection. The protective treatment is applied from an aqueous medium, possibly from solvent systems containing lower alcohols and water, depending upon the characteristics of the silanes. Representative of this stage of the art are: U.S. Pat. No. 3,085,908, Morehouse et al., U.S. Pat. No. 3,175,921, Hedlund, and French Pat. No. 1,207,724, Morehouse et al.

Quaternized amino-silanes are known, from U.S. Pat. No. 4,005,118, Heckert et al. and U.S. Pat. No. 4,005,025, Kinstedt, to be suitable for conferring soil release properties to metallic and vitreous surfaces upon application from a wash or rinse-solution. The like quaternized amino-silanes, upon incorporation in aqueous detergents, are subject to deactivation, possibly following polymerization during storage.

It is also generally known that silane metal-surface treatment is usually carried out under slightly acidic conditions (pH 3–5) in order to prevent polymerization of the silane monomers in the aqueous medium, which polymerization is known to decrease the effectiveness of the surface treatment.

The preparation of a broad class of gamma-aminopropylalkoxysilanes is known from German Application DOS No. 17 93 280.

Silanes, inclusive of amino-silanes, have been used in industrial fiber treatment technology, mostly in combination with polysiloxanes. This art is represented by German Patent Applications: DOS No. 27 26 108; DOS No. 14 69 324; DAS No. 23 35 751; and U.S. Pat. No. 4,152,273, Weiland.

Such known industrial fiber/substrate treatments quantitatively aim at chemically attaching, to the substrate, an organic polymer with a view to impart permanently modified fiber properties such as water-repellency, shrink-proofing, bactericidal properties, and so on. Silanes are used in a coupling/adhesion agent functionality, i.e., the silane is non-releasably affixed to the substrate. For example, a process for giving permanent shrink resistent properties to woollens as known from Belgian Pat. No. 802.311, Dow Corning, uses a mixture of organopolysiloxanes and silanes.

Treatment compositions for synthetic fibers containing amino-silanes and epoxysiloxanes are known from German Patent Application DAS No. 25 05 742, Tenijin Ltd. The treated fibers have enhanced compression-elasticity, smoothness, flexibility, softeness and good usage characteristics. The silane acts as a coupling agent for depositing the active ingredient, i.e., the silicones.

French Patent Application No. 2.299.447, Rhone-Poulenc, describes flexible water-insoluble substrates impregnated with a detergent suds regulant, preferably an orango-polysiloxane, in a level such that the regulant represents from 1% to 200% of the substrate.

None of the prior art references addresses the problems inherent in the development of laundry additives with a view of conferring, better machine compatibility, especially in relation to enamel-coated surfaces. This compatibility results from the use of the laundry additive itself. In addition, the surface protection lasts throughout the subsequent laundry treatments carried out in the machine.

It has now been found that specific amino-silanes can be used as silicate-substitutes in laundry liquors and in the concurrently filed application Ser. No. 421,187, now U.S. Pat. No. 4,416,793 entitled "Liquid detergent compositions containing amino-silanes", amino-silanes are disclosed which have acceptable stability and performance characteristics in such compositions.

It is an object of the present invention to provide a solid laundry additive product comprising an amino-silane, effective in preventing or inhibiting vitreous enamel corrosion in aqueous detergent media, in combination with an inert carrier.

SUMMARY OF THE INVENTION

According to the present invention there is provided a laundry additive product for inhibiting or preventing the corrosion of enamelled surfaces comprising a composition comprising an amino-silane having the formula $$(R_1O)_{3-x}-\overset{(R_1)_x}{\overset{|}{Si}}-(CH_2)_m-N(R_3)_2$$

$R_1$=$C_{1-4}$-alkyl or $C_{1-4}$-hydroxyalkyl;
X is 0 or 1;
m is 1–6;
$R_3$ is hydrogen, $R_1$, $C_{1-6}$-alkylamine, $$-\left[(CH_2)_n-\overset{R_4}{\overset{|}{N}}\right]_y-R_5$$

$R_4$ is hydrogen or $R_1$;
n is 1–6;
y is 0–6;
$R_5$=$R_4$, $$-(CH_2)_p-\underset{\underset{O}{\|}}{C}-OR_1, \quad \text{or} \quad -\underset{\underset{O}{\|}}{C}-\underset{\underset{H}{|}}{N}R_4;$$

p=1–6; the $R_3$'s can be identical or different. said composition being impregnated in and/or coated on a flexible, non particulate substrate, in a weight ratio of amino-silane to substrate of from 1:5000 to 1:1.

Depending upon the contemplated utilization of the laundry additive, this product can comprise further adjuvants and/or modifiers with a view to e.g. homogeneously distribute the silane throughout the additive.

The term "enamel" in enamel-coated is meant to embrace a vitreous, opaque, transparent glaze fused over metal.

DETAILED DESCRIPTION OF THE INVENTION

The laundry additive of the present invention comprises two essential components namely the amino-silane and the flexible non particulate substrate, the weight ratio of the amino-silane to the substrate conveniently being in the range of from 1:5000 to 1:1, more usually from 1:2500 to 1:2, preferably from 1:500 to 1:50.

The amino-silane component has the formula:

$$(R_1O)_{3-x}-\overset{(R_1)_x}{\overset{|}{Si}}-(CH_2)_m-N(R_3)_2$$

wherein:
$R_1$=$C_{1-4}$-alkyl or $C_{1-4}$-hydroxyalkyl;
x is 0 or 1;
m is 1–6;
$R_3$ is hydrogen, $R_1$, $C_{1-6}$-alkylamine, or $$-\left[(CH_2)_n-\overset{R_4}{\overset{|}{N}}\right]_y-R_5$$

$R_4$ is hydrogen or $R_1$;
n is 1–6;
y is 0–6;
$R_5$=$R_4$, $$-(CH_2)_p-\underset{\underset{O}{\|}}{C}-OR_1, \quad \text{or} \quad -\underset{\underset{O}{\|}}{C}-\underset{\underset{H}{|}}{N}-R_4;$$

p=1–6.
The $R_3$'s can be identical or different.

Preferred amino-silanes for use herein can carry the following substituents:
$R_1$=$-CH_3$ or $-C_2H_5$
x=0
m=2 or 3
$R_3$=hydrogen and $$-\left[(CH_2)_{2-3}-\overset{R_4}{\overset{|}{N}}\right]_{1-2}-R_5$$

$R_4$=hydrogen or methyl
$R_5$=hydrogen or methyl.

The most preferred amino-silanes have the following chemical formula:

$(CH_3-O)_3-Si-(CH_2)_3-NH-(CH_2)_2-NH_2$ (a)

$(CH_3-O)_3-Si-(CH_2)_3-NH-(CH_2)_3-NH_2$ (b)

$(CH_3-O)_3-Si-(CH_2)_3-NH-(CH_2)_2-NH(CH_2)_2NH_2$ (c)

The above structural formulae correspond to the following chemical names:

N-(trimethoxysilylpropyl)-ethylene diamine (a)

N-(trimethoxysilylpropyl)-propylene diamine (b)

N-(trimethoxysilylpropyl)-diethylene triamine (c).

The compositions herein comprise an amino-silane in water-releasable combination with a solid non particulate substrate. Preferably the substrate is absorbent and the amino-silane is impregnated herein. Application of the aminosilane can be carried out in any convenient manner, and many methods are known in the art. For example, the amino-silane in liquid form can be sprayed onto a substrate as it is manufactured. The amino-silane can also be applied in combination with other optional laundry ingredients as more fully explained hereinafter. In such an instance, it may be desirable to e.g. predisperse the silane in the optional components before application to the substrate, such application can be termed either as "coating" or "impregnation". The term "coating" connotes the adjoining of one substance to the surface of another; "impregnation" is intended to mean the permeation of the entire substrate structure, internally as well as externally. One factor affecting a given substrate absorbent capacity is its free space. Accordingly, when an amino-silane is applied to an absorbent substrate, it penetrates into the free space, hence, the substrate is deemed impregnated. The free space in a substrate of low absorbency, such as a one-ply kraft or bond paper, is very limited; such a substrate is, therefore, termed "dense". Thus, while a small portion of the amino-silane penetrates into the limited free space available in a dense substrate, a rather substantial balance of the amino-silane does not penetrate and remains on the surface of the substrate so that it is deemed a coating.

In one method of making an amino-silane-impregnated sheet-like substrate, the amino-silane is applied to absorbent paper or non-woven cloth by a method generally known as padding.

In this method, the amino-silane, in liquid form, is placed into a pan or trough. Any desired optional component is added to the amino-silane and the pan or trough is heated if necessary to maintain the mixture in liquid form.

A roll of absorbent substrate is then set up on an apparatus so that it can unroll freely. As the substrate unrolls, it travels downwardly and, submersed, passes through the pan or trough containing the liquid amino-silane at a low enough speed to allow sufficient impregnation. The absorbent substrate then travels, at the same speed, upwardly and through a pair of rollers which squeeze off excess bath liquid. The impregnated substrate is then cooled to room temperature, after which it can be folded, cut or perforated at uniform lengths, and subsequently packaged and/or used.

The rollers used resemble "squeeze rolls" used by those in the paper and paper-making art; they can be made of hard rubber or steel. Preferably, the rollers are adjustable, so that the orifice between their respective surfaces can be regulated to control the amount of the amino-silane liquid on the substrate.

In a preferred execution of the invention, the amino-silane in liquid form, is sprayed onto absorbent substrate as it unrolls. The unrolled substrate web is arranged to slide over the spray nozzle which comprises a horizontally disposed tube formed with a slit extending along its top surface. The slurry of amino-silane and any additives mixed therewith is forced through the slit into the substrate and the excess liquid is then squeezed off by the use of squeeze rollers.

The substrate comprises a flexible non particulate article and may have any one of a number of physical forms such as sheets, blocks, rings, balls, rods, tubes and other shapes that are emanable to unit usage by the consumer. The substrate may itself be water soluble or water insoluble and in the latter case should preferably possess sufficient structural integrity, when wet, to permit its recovery from a washing machine at the end of a laundry cycle.

Water soluble materials include certain cellulose ethers, alginates, polyvinyl alcohol and water soluble polyvinyl pyrrolidone polymers, which can be formed into non-woven and woven fibrous structures. Suitable water insoluble materials include, but are not restricted to, natural and synthetic fibres, foams, sponges and films.

A highly preferred substrate for use in the invention is a sheet, and more preferably a water pervious sheet to permit water to pass from one surface of the sheet to the other. Where a continuous film substrate is employed perforation of the film is desirable.

The most preferred form of the substrate is a sheet of woven or non-woven fabric or a thin sheet of cellular plastic material. Woven fabric sheets can take the form of a plain weave natural or synthetic fibre of low fibre count/unit length, such as is used for surgical dressings, or of the type known as cheese cloth.

A very desirable attribute of the laundry additive products of the present invention is that they do not interfere with the mechanical operation of the equipment into which they are put. A high proportion of domestic washing machines are of the rotating perforated drum type in which the perforations extend over the entire peripheral surface. In this type of equipment the drum construction and the mode of operation obviates any problem of obstruction to liquid flow in the machine. Certain older types of washing machine utilise an agitator in a stationary vessel provided with a recirculating liquid system. Likewise many laundry dryers have their exhaust vent in a location within the machine where a sheet-form substrate can become disposed over the vent and thus significantly reduce the flow of exhaust gas from the dryer. In order to avoid liquid blockage in these older washing machines and exhaust gas blockage in dryers, it is desirable to provide slits or perforations in the substrate, particularly if it is in sheet form. Sheet structures of this type are disclosed in McQueary U.S. Pat. Nos. 3,944,694 and 3,956,556 issued Mar. 16, 1976 and May 11, 1976 respectively.

A desirable feature of a substrate to be utilised in the present invention herein is that it be absorbent in nature. It is known that most substances are able to absorb a liquid substance to some degree; however, the term "absorbent", as used herein, is intended to mean a substance with an absorbent capacity (i.e., values representing a substrate's ability to take up and retain a liquid) of up to approximately 25 times its weight of water.

Determination of absorbent capacity values is made by using the capacity testing procedures described in U.S. Federal Specificlation UU-T595b modified as follows:

(1) tap water is used instead of distilled water;
(2) the specimen is immersed for 30 seconds instead of 3 minutes;
(3) draining time is 15 seconds instead of 1 minute; and
(4) the specimen is immediately weighed on a torsion balance having a pan with turned-up edges.

Absorbent capacity values are then calculated in accordance with the formula given in said specification. Based on this test, one-ply, dense, bleached paper (e.g. kraft or bond) having a basis weight of about 32 pounds per 3,000 square feet, has an absorbent capacity of 3.5 to 4; commercially available household one-ply towelling paper has a value of 5 to 6; and, commercially available two-ply household towelling paper has a value of 7 to about 9.5.

The substrate of this invention can also be defined in terms of "free space". Free space, also called "void volume", as used herein is intended to mean that space within a structure that is unoccupied. For example, certain multi-ply paper structures comprise plies embossed with protuberances, the ends of which are mated and joined; such a paper structure has a void volume of free space between the unembossed portion of the plies, as well as between the fibres of the paper sheet itself. A non-woven cloth also has such space between each of its fibres. The free space of non-woven cloth or paper, having designated physical dimensions, can be varied by modifying the density of the fibres of the paper or non-woven cloth. Substrates with a high amount of free space generally have low fibre density; high density substrates generally have a low amount of free space. Preferred substrates of the invention herein have up to about 90% free space based on the overall volume of the substrate structure.

As stated above, suitable materials which can be used as a substrate in the invention herein include, among others sponges, paper, and woven and non-woven fabrics. The preferred substrates of the laundry additive products herein are cellulosic, particularly apertured and non-apertured non-woven fabrics.

Specifically, one suitable substrate is a compressible, laminated, calendered, multi-ply absorbent paper structure. Preferably, the paper structure has 2 or 3 plies and a total basis weight of from 14 to 90 pounds per 3,000 square feet and absorbent capacity values within the range of 7 to 10. Each ply of the preferred paper structure has a basis weight of about 7 to 30 pounds, per 3,000 square feet, and the paper structure can consist of plies having the same or different basis weights. Each ply is preferably made from creped, or otherwise extensible, paper with creped percentage of about 15% to 40% and a machine direction (MD) tensile and cross-machine (CD) tensile of from about 100 to 1,500 grams per square inch of paper width. The two outer plies of a 3-ply paper structure or each ply of a 2-ply paper structure are embossed with identical repeating patterns consisting of about 16 to 200 discrete protuberances per square inch, raised to a height of from about 0.010 inch to 0.40 inch above the surface of the unembossed paper sheet. From about 10% to 60% of the paper sheet surface is raised. The distal ends (i.e. the ends away from the unembossed paper sheet surface) of the protuberances on each ply are mated and adhesively joined together, thereby providing a preferred paper structure exhibiting a compressive modulus of from about 200 to 800 inch-grams per cubic inch and Handle-O-Meter (HOM) MD and CD values of from about 10 to 130.

The compressive modulus values which define the compressive deformation characteristics of paper structure compressively loaded on its opposing surfaces, the HOM values which refer to the stiffness or handle of a paper structure, the MD and CD HOM values which refer to HOM values obtained from paper structure samples tested in a machine and cross-machine direction, the methods of determining these values, the equipment used, and a more detailed disclosure of the paper structure preferred herein, as well as methods of its preparation, can be found in Edward R. Wells, U.S. Pat. No. 3,414,459, issued on Dec. 3, 1968.

The preferred non-woven fabric substrates usable in the invention herein can generally be defined as adhesively bonded fibrous or filamentous products, having a web or carded fibre structure (where the fibre strength is suitable to allow carding) or comprising fibrous mats, in which the fibres or filaments are distributed haphazardly or in random array (i.e. an array of fibres in a carded web wherein partial orientation of the fibres is frequently present as well as a completely haphazard distributional orientation) or substantially aligned. The fibres or filaments can be natural (e.g. wool, silk, wood pulp, jute, hemp, cotton, linen, sisal, or ramie), synthetic (e.g. rayon, cellulose, ester, polyvinyl derivatives, polyolefins, polyamides, or polyesters) or mixtures of any of the above.

Methods of making non-woven cloths are not a part of this invention and being well known in the art, are not described in detail herein. Generally, such cloths are made by air or water laying processes in which the fibres or filaments are first cut to desired lengths from long strands, passed into a water or air stream, and then deposited onto a screen through which the fibre-laden air or water is passed. The deposited fibres or filaments are then adhesively bonded together, dried, cured and otherwise treated as desired to form the non-woven cloth. Non-woven cloths made of polyesters, polyamides, vinyl resins, and other thermoplastic fibres can be spun-bonded, i.e. the fibres are spun out onto a flat surface and bonded (melted) together by heat or by chemical reactions.

The absorbent properties desired herein are particularly easy to obtain with non-woven cloths and are provided merely by building up the thickness of the cloth, i.e. by superimposing a plurality of carded webs or mats to a thickness adequate to obtain the necessary absorbent properties, or by allowing a sufficient thickness of the fibres to deposit on the screen. Any diameter or denier of the fibre (generally up to about 10 denier) can be used, inasmuch as it is the free space between each fibre that makes the thickness of the cloth directly related to the absorbent capacity of the cloth, and which further makes the non-woven cloth especially suitable for impregnation with a peroxy compound precursor by means of intersectional or capillary action. Thus, any thickness necessary to obtain the required absorbent capacity can be used.

The choice of binder-resins used in the manufacture of non-woven cloths can provide substrates possessing a variety of desirable traits. For example, the absorbent capacity of the cloth can be increased, decreased, or regulated by respectively using a hydrophilic binder-resin, a hydrophobic binder-resin or a mixture thereof in the fibre bonding step. Moreover, the hydrophobic binder-resin, when used singly or as the predominant compound of hydrophobic-hydrophilic mixture, provides non-woven cloths which are especially useful as substrates when the precursor-substrate combinations disclosed herein are used in an automatic washer.

When the substrate herein is a non-woven cloth made from fibres, deposited haphazardly or in random array on the screen, the compositions exhibit excellent strength in all directions and are not prone to tear or separate when used in the washer.

Preferably, the non-woven cloth is water-laid or air-laid and is made from cellulosic fibres, particularly from regenerated cellulose or rayon, which are lubricated with standard textile lubricant. Preferably, the fibres are from 3/16" to 2" in length and are from 1.5 to 5 denier (Denier is an internationally recognised unit in yarn measure, corresponding to the weight in grams of a 9,000 meter length of yarn). Preferably, the fibres are at least partially orientated haphazardly, particularly substantially haphazardly, and are adhesively bonded together with hydrophobic or substantially hydrophobic binder-resin, particularly with a nonionic self-crosslinking acrylic polymer or polymers. Conveniently, the cloth comprises about 70% fibre and 30% binder-resin polymer by weight and has a basis weight of from 10 to about 100, preferably 20–60 grammes per square yard.

A suitable example is an air-laid, non-woven cloth comprising 70% regenerated cellulose (American Viscose Corporation) and 30% hydrophobic binder-resins (Rhoplex HA-8 on one side of the cloth, Rhoplex HA-16 on the other; Rohm & Haas, Inc.). The cloth has a thickness of 4 to 5 mils., a basis weight of about 24 grams per square yard, and an absorbent capacity of 6. One foot length of the cloth $8\frac{1}{3}$" wide, weighs about 1.78 grams. The fibres are $\frac{1}{4}$" in length, 1.5 denier, and are orientated substantially haphazardly. The fibres are lubricated with sodium oleate.

A further exemplary substrate is a water-laid, non-woven cloth commercially available from C. H. Dexter Co., Inc. The fibres are regenerated cellulose, about $\frac{3}{8}$" in length, about 1.5 denier, and are lubricated with a similar standard textile lubricant. The fibres comprise about 70% of the non-woven cloth by weight and are orientated substantially haphazardly; the binder-resin (HA-8) comprises about 30% by weight of the cloth. The substrate is about 4 mils. thick, and it has a basis weight of about 24 grams per square yard and an absorbent capacity of 5.7. One foot length of the cloth, $8\frac{1}{3}''$ wide, weighs about 1.66 grams.

Apertured non-woven substrates are also useful for the purposes of the present invention. The apertures, which extend between opposite surfaces of the substrate are normally in a pattern and are formed during laydown of the fibres to produce the substrate. Exemplary apertured non-woven substrates aredisclosed in U.S. Pat. Nos. 3,741,724, 3,930,086 and 3,750,237.

One particularly suitable example of an apertured non-woven substrate is that obtainable from Chicopee Manufacturing Co., Milltown, N.J., under the Code No. SK 650 WFX 577 and comprising a polyester-wood pulp mixture having a basis weight of 50 grs/sq. meter and approximately 13 apertures per sq. cm.

Another preferred example of an apertured non-woven substrate, also available from Chicopee Manufacturing Co., under the Code No. AK 30 ML 1379 comprises a regenerated cellulose sheet of 3.0 denier fibres bonded with Rhoplex RA 8 binder (fibre:binder ratio 70:30) having a basis weight of 40 grs/sq meter and 17 apertures/sq cm.

In general, apertured fabrics for the purposes of the invention have from 10–20 apertures/sq cm preferably 12–18 apertures/sq cm.

A further class of substrate material that can be used in the present invention comprises an absorbent foam-like material in the form of a sheet. The term 'absorbent foam-like material' is intended to encompass three-dimensional absorptive materials such as 'gas blown foams', natural sponges and composite fibrous based structures such as are disclosed in U.S. Pat. Nos. 3,311,115 and 3,430,630 specifically incorporated herein by reference. A particularly suitable material of this type is a hydrophilic polyurethane foam in which the internal cellular walls of the foam have been broken by reticulation. Foams of this type are described in detail in Dulle U.S. Pat. No. 3,794,029 which is hereby specifically incorporated by reference. A preferred example of this foam type comprises a hydrophilic polyurethane foam of density about 0.596 grs. per cubic inch with a cell count of between 20 and 100 cells per inch, preferably about 60 to 80 per inch available from the Scott Paper Company, Eddystone, Pa., U.S.A., under the Registered Trade Mark "Hydrofoam".

The size and shape of the substrate sheet is a matter of choice and is determined principally by factors associated with the convenience of its use. Thus the sheet should not be so small as to become trapped in the crevices of the machine or the clothes being washed or so large as to be awkward to package and dispense from the container in which it is sold. For the purposes of the present invention sheets ranging in plan area from 20 square inches to 200 square inches are acceptable, the preferred area lying in the range of from 80 to 120 square inches.

OPTIONAL COMPONENTS

In addition to the amino-silane, one or more other materials can be applied to the substrate either separately or together with the amino-silane.

The type and level of such optional, functional components is constrained only by the requirements of unreactivity towards the amino-silane (if the optional materials are applied so as to be in intimate contact with the amino-silane) and by the loading limitations of the substrate. As described in more detail hereinafter, materials that are capable of reaction with the amino-silane can be incorporated in additive products of the present invention but it is essential that the amino-silane is spatially separate therefrom, i.e. is disposed at a substrate location that is free or substantially free of the other reactant materials. Individual optional components can be incorporated in amounts up to those corresponding to component-substrate weight ratios of 20:1. However, for processing and product aesthetics reasons, the total weight of optional components per sheet is normally held to a maximum of 10 times the sheet weight, individual components being present at no more than 3 times the sheet weight.

One factor determining the acceptable level of incorporation of an optional ingredient is its physical characteristics i.e. whether it is liquid or solid and if solid whether it is crystalline or waxy and of high or low melting or softening point.

The most preferred optional components are solid, water-soluble or water-dispersible organic adjuvants of a waxy nature having a softening point greater than 40° C. and a melting point less than 80° C. to permit their easy processing.

The amino-silanes useful in the present invention are high boiling mobile liquids. Accordingly it is preferred to incorporate one or more organic adjuvants as described above to serve as an aid in processing and/or in releasing the amino-silane from the substrate when the latter is introduced into a wash liquor. The preferred adjuvants serve as plasticisers or thickeners in the incorporation of the amino-silanes into or onto the substrate and ideally are non-hygroscopic solids that are mixed with the amino-silanes and melted to provide mixtures having a viscosity of up to 5,000 centipoises at 50° C.

Typical adjuvants are polyvinyl pyrrolidone of Mwt. 44,000–700,000 preferably 500,000–700,000, $C_{12}$–$C_{18}$ alcohol ethoxylates containing from 15 to 80 ethylene oxide groups per mole of alcohol, $C_{12}$–$C_{18}$ fatty acids and certain esters and amides thereof, sorbitan esters of $C_{16}$–$C_{18}$ fatty acids and polyethylene glycols of Mwt. 4,000. As stated hereinbefore preferred materials are those of low hygroscopicity particularly the $C_{14}$–$C_{18}$ saturated fatty acids.

In a preferred embodiment of the invention incorporating one or more specified nonionic surfactants for grease and oil removal (to be described hereinafter), the nonionic surfactant or surfactants can serve as a processing aid thereby reducing or even eliminating the need for an additional processing aid.

A preferred optional component is an organic peroxyacid precursor of the type disclosed in British Pat. No. 158769 particularly preferred examples being tetra acetyl ethylene diamine and tetra acetyl methylene diamine.

In addition to the foregoing optional components, other detergent ingredients may be incorporated on the substrate provided that they are unreactive towards amino-silanes and (if present) organic peroxybleach precursors. Thus, surfactants, suds modifiers, chelating agents, anti-redeposition and soil suspending agents, optical brighteners, bactericides, anti-tarnish agents, enzymatic materials, fabric softeners, anti-static agents, perfumes and bleach catalysts can all be introduced into a wash liquor by means of the additive products of the present invention, subject to the constraints imposed by the loading limitations of the substrate.

The surfactants can be any one or more surface active agents selected from anionic, nonionic, zwitterionic, amphoteric and cationic classes and mixtures thereof. Anionic surface active agents can be natural or synthetic in origin; nonionic surface active agents can be either semi-polar or alkylene oxide types and cationic surfactants can include amine salts, quaternary nitrogen and phosphorus compounds and ternary sulphonium compounds. Specific examples of each of these classes of compounds are disclosed in Laughlin+Heuring U.S. Pat. No. 3,929,678 issued Dec. 30, 1975.

Suitable anionic non-soap surfactants are water soluble salts of alkyl benzene sulphonates, alkyl sulphates, alkyl polyethoxy ether sulphates, paraffin sulphonates, alphaolefin sulphonates, alpha-sulphocarboxylates and their esters, alkyl glyceryl ether sulphonates, fatty acid monoglyceride sulphates and sulphonates, alkyl phenol polyethoxy ether sulphates, 2-acyloxy-alkane-1-sulphonates, and beta-alkyloxy alkane sulphonates. Soaps are also suitable anionic surfactants.

Especially preferred alkyl benzene sulphonates have about 9 to about 15 carbon atoms in a linear or branched alkyl chain, more especially about 11 to about 13 carbon atoms. Suitable alkyl sulphates have about 10 to about 22 carbon atoms in the alkyl chain, more especially from about 12 to about 18 carbon atoms. Suitable alkyl polyethoxy ether sulphates have about 10 to about 18 carbon atoms in the alkyl chain and have an average of about 1 to about 12 —$CH_2CH_2O$— groups per molecule, especially about 10 to about 16 carbon atoms in the alkyl chain and an average of about 1 to about 6 —$CH_2CH_2O$— groups per molecule.

Suitable paraffin sulphonates are essentially linear and contain from about 8 to about 24 carbon atoms, more especially from about 14 to about 18 carbon atoms. Suitable alpha-olefin sulphonates have about 10 to about 24 carbon atoms, more especially about 14 to about 16 carbon atoms; alpha-olefin sulphonates can be made by reaction with sulphur trioxide followed by neutralization under conditions such that any sultones present are hydrolyzed to the corresponding hydroxy alkane sulphonates. Suitable alpha-sulphocarboxylates contain from about 6 to about 20 carbon atoms; included herein are not only the salts of alpha-sulphonated fatty acids but also their esters made from alcohols containing about 1 to about 14 carbon atoms.

Suitable alkyl glyceryl ether sulphates are ethers of alcohols having about 10 to about 18 carbon atoms, more especially those derived from coconut oil and tallow. Suitable alkyl phenol polyethoxy ether sulphates have about 8 to about 12 carbon atoms in the alkyl chain and an average of about 1 to about 6—$CH_2CH_2O$— groups per molecule. Suitable 2-acyloxy-alkane-1-sulphonates contain from about 2 to about 9 carbon atoms in the acyl group and about 9 to about 23 carbon atoms in the alkyl group and about 8 to about 20 carbon atoms in the alkane moiety.

The alkyl chains of the foregoing non-soap anionic surfactants can be derived from natural sources such as coconut oil or tallow, or can be made synthetically as for example using the Ziegler or Oxo processes. Water solubility can be achieved by using alkali metal, ammonium, or alkanolammonium cations; sodium is preferred. Mixtures of anionic surfactants are contemplated by this invention; a satisfactory mixture contains alkyl benzene sulphonate having 11 to 13 carbon atoms in the alkyl group and alkyl sulphate having 12 to 18 carbon atoms in the alkyl group.

Suitable soaps contain about 8 to about 24 carbon atoms, more especially about 12 to about 18 carbon atoms. Soaps can be made by direct saponification of natural fats being such that hydrophilicity increases with increase in HLB value. For nonionic surfactants containing ethylene oxide the HLB value can be expressed as HLB=E/5, where E is the percentage by weight of ethylene oxide in the Organic molecules having the desired hydrophobicity and a reactive hydrogen atom include linear and branched chain primary and secondary $C_9$–$C_{15}$ aliphatic alcohols, $C_{12}$–$C_{18}$ alkyl phenols.

Examples of suitable nonionic surfactants are:

Linear
- $C_{14}$–$C_{15}$ alcohol ($E_7$)
- $C_{14}$–$C_{15}$ alcohol ($E_5$)
- $C_{12}$–$C_{13}$ alcohol ($E_6$)
- $C_9$–$C_{11}$ alcohol ($E_5$)

Branched
- $C_{10}$–$C_{13}$ alcohol ($E_4$)

Linear
- s —$C_{11}$–$C_{15}$ alcohol ($E_5$)
- s —$C_{11}$–$C_{15}$ alcohol ($E_7$)
- s —$C_{11}$–$C_{15}$ alcohol ($E_9$)
- Coconut fatty acid ($E_5$)
- Oleic fatty acid ($E_{10}$)

Linear
- $C_8$ Alkyl phenol ($E_5$)
- $C_8$ Alkyl phenol ($E_8$)
- $C_9$ Alkyl phenol ($E_6$)
- $C_9$ Alkyl phenol ($E_9$)

Sorbitan monoleate ($E_5$)
Sorbitan trioleate ($E_{20}$)
Sorbitan monostearate ($E_4$)
Sorbitan tristearate ($E_{20}$)

Particularly preferred materials are the primary linear and branched chain primary alcohol ethoxylates, containing from 7 to 20 ethylene oxide groups per mole of alcohol, such as $C_{14}$–$C_{15}$ linear alcohols condensed with 7–15 moles of ethylene oxide available from Shell Oil Co. under the "Neodol" Trade Mark and the $C_{10}$–$C_{13}$ branched chain alcohols obtainable from Liquidchimica SA under the "Lial" Trade Mark.

The amount of the nonionic-surfactant mixture is such that the nonionic surfactant-substrate weight ratio lies in the range 20:1 to 1:5, preferably from 10:1 to 1:2, and most preferably from 5:1 to 1:1. In preferred executions using non-woven sheet substrates of approximately 100 sq. ins. plan area and $\approx$3 grs./sheet basis weight, the loading of nonionic-surfactant is in the range 5–15 grs./sheets.

Where the nonionic-surfactant is a liquid at normal temperatures, its physical incorporation can take place in a number of ways. Where the substrate comprises a non-sheet like reticulated foam article, direct impregnation of the article by the surfactant, either alone or with other components of the formulation can be used, employing methods known in the art and described in more detail hereinafter. Where the substrate comprises a non-woven material or a foam article of sheet-like form, it is preferred to mix the surfactant with a compatible non-hydroscopic material of higher melting point, such as the processing aids hereinbefore described to provide a waxy solid in which the surfactant is present in the form of a solid solution and/or as a dispersed phase. The melting point range and waxy nature of polyethylene glycols of molecular weight >4000 make them useful for this purpose, although their hygroscopicity under extreme conditions of humidity leads to high levels of moisture pick-up if appreciable amounts of such glycols are used. Other useful materials include $C_{12}$–$C_{18}$ fatty acid alkanolamides. However, the preferred materials are the higher fatty acids, particularly the $C_{16}$–$C_{18}$ saturated fatty acids which are employed in an amount such that the weight ratio of fatty acid to the nonionic component of the surfactant is in the range 1:5 to 4:1, preferably 1:3 to 3:2 and most preferably 2:3 to 1:1.

Where the surfactant is a solid at normal temperature but is molten at a temperature less than about 100° C. preferably less than about 80° C., the surfactant itself can be used as the vehicle for incorporating other non-liquid components into the substrate. Surfactant comprising a highly ethoxylated nonionic such as Tallow alcohol ($E_{25}$) or $C_{14}$–$C_{15}$ primary alcohol ($E_{15}$) are examples of this type.

A wide range of cationic surfactants can be used as disclosed in U.S. Pat. No. 4,220,562 Columns 6–12. Preferred examples of such surfactants are mono long chain quaternary ammonium salts that include a $C_{10}$–$C_{20}$ alkyl group more preferably a $C_{10}$–$C_{16}$ alkyl group or a $C_{10}$–$C_{15}$ alkylbenzyl group. Particularly preferred compositions of this class include $C_{12}$ alkyl trimethyl ammonium bromide, $C_{12}$ alkyl dimethyl hydroxyethyl ammonium bromide, $C_{12}$ alkyl dimethyl hydroxypropyl ammonium bromide, $C_{12}$ alkyl dimethylbenzyl ammonium chloride and their counterparts based on middlecut coconut alcohol as the source of the alkyl group. Other counter ions such as methosulphate, sulphate, sulphonate and carboxylate can also be used particularly with the hydroxyalkyl-substituted compounds. Preferred compositions incorporate mixtures of cationic and nonionic surfactants in weight ratios ranging from 1:20 to 2:1 more preferably from 1:10 to 1:1.

Other optional ingredients include suds modifiers which can be of the suds boosting, suds stabilising or suds suppressing type. Examples of the first type include the $C_{12}$–$C_{18}$ fatty acid amides and alkanol amides, the second type is exemplified by the $C_{12}$–$C_{16}$ alkyl dilower alkyl amine oxides and the third type by $C_{20}$–$C_{24}$ fatty acids, certain ethylene oxide-propylene oxide copolymers such as the "Pluronic" series, silicones, silica-silicone blends, micro-crystalline waxes, triazines and mixtures of any of the foregoing.

Preferred suds suppressing additives are described in U.S. Pat. No. 3,933,672, issued Jan. 20, 1976, Bartolotta et al., relative to a silicone suds controlling agent. The silicone material can be represented by alkylated polysiloxane materials such as silica aerogels and xerogels and hydrophobic silicas of various types. The silicone material can be described as siloxane having the formula:

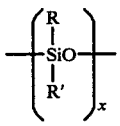

wherein X is from about 20 to about 2,000, and R and R′ are each alkyl or aryl groups, especially methyl, ethyl propyl, butyl and phenyl. The polydimethylsiloxanes (R and R′ are methyl) having a molecular weight within the range of from about 200 to about 200,000, and higher, are all useful as suds controlling agents. Additional suitable silicone materials wherein the side chain groups R and R′ are alkyl, aryl, or mixed alkyl and aryl hydrocarbyl groups exhibit useful suds controlling properties. Examples of the like ingredients include diethyl-, dipropyl-, dibutyl-, methyl-, ethyl-, phenyl-, methyl-polysiloxanes and the like. Additional useful silicone suds controlling agents can be represented by a mixture of an alkylated siloxane, as referred to hereinbefore, and solid silica. Such mixtures are prepared by affixing the silicone to the surface of the solid silica. A preferred silicone suds controlling agent is represented by a hydrophobic silanated (most preferably trimethylsilanated) silica having a particle size in the range from about 10 millimicrons to 20 millimicrons and a specific surface area above about 50 $m^2$/gm. intimately admixed with dimethyl silicone fluid having a molecular weight in the range from about 500 to about 200,000 at a weight ratio of silicone to silanated silica of from about 19:1 to about 1:2. The silicone suds suppressing agent is advantageously releasably incorporated in a water-soluble or water-dispersible, substantially non-surface-active detergent-impermeable carrier.

Particularly useful suds suppressors are the self-emulsifying silicone suds suppressors, described in U.S. patent application Ser. No. 622,303, Gault et al, filed Oct. 14, 1975. An example of such a compound is DB-544, commercially available from Dow Corning, which is a siloxane/glycol copolymer.

Suds modifiers as described above are incorporated at levels of up to approximately 5%, preferably from 0.1 to 2% by weight of the cationic-nonionic surfactant mixture.

Chelating agents that can be incorporated include citric acid, nitrilotriacetic and ethylene diamine tetra acetic acids and their salts, organic phosphonate derivatives such as those disclosed in Diehl U.S. Pat. No. 3,213,030 issued Oct. 19, 1965, by Roy U.S. Pat. No. 3,433,021 issued Jan. 14, 1968, Gedge U.S. Pat. No. 3,292,121 issued Jan. 9, 1968, Bersworth U.S. Pat. No. 2,599,807 issued June 10, 1952, and carboxylic acid builders such as those disclosed in Diehl U.S. Pat. No. 3,308,067 issued Mar. 7, 1967. Preferred chelating agents include nitrilotriacetic acid (NTA), nitrilotrimethylene phosphonic acid (NTMP), ethylene diamine tetra methylene phosphonic acid (EDTMP) and diethylene triamine penta methylene phosphonic acid (DETPMP), and the chelating agents are incorporated in amounts such that the substrate chelating agent weight ratio lies in the range 20:1 to 1:5, preferably 5:1 to 1:5 and most preferably 3:1 to 1:1. Certain polybasic acids have been found to enhance the bleaching effect of organic peroxyacids produced, examples being EDTMP, NTMP and DETPMP. However, not all chelating polybasic acids are useful in this respect, while certain poorly-chelating polybasic acids, notably succinic acids, and glutaric acid, do show efficacy.

Anti-redeposition and soil suspension agents can also be incorporated. Soil-suspending agents at about 0.1% to 10% by weight such as water-soluble salts of carboxymethyl-cellulose, carboxyhydroxymethyl cellulose, polyethylene glycols having a molecular weight of about 400 to 10,000 and copolymers of maleic anydride with methyl vinyl ether, ethylene or acrylic acid, are common components of the present invention.

Preferred enzymatic materials include the commercially available amylases, and neutral and alkaline proteases conventionally incorporated into detergent compositions. Because of their heat sensitivity, these materials require incorporation at or close to ambient temperatures and thus addition to a melt of the amino-silane and other additives is not possible. Accordingly enzymatic materials are best applied in processes utilising solvent or slurry application of the amino-silane to the substrate.

Optical brighteners may be anionic or nonionic in type and are added at levels of from 0.05 to 1.0 grs per sheet preferably 0.1 to 0.5 grs per sheet.

Anionic fluorescent brightening agents are well-known materials, examples of which are disodium 4,4'-bis-(2-diethanolamino-4-anilino-s-triazin-6-ylamino) stilbene-2:2'disulphonate, disodium 4,4'-bis-(2-morpholino-4-anilino-s-triazin-6-ylamino stilbene-2:2'-disulphonate, disodium 4,4'-bis-(2,4-dianilino-s-triazin-6-ylamino)stilbene-2:2'-di-sulphonate, disodium 4,4'-bis-(2-anilino-4-(N-methyl-N-2-hydroxyethylamino)-s-triazin-6-ylamino)stilbene-2,2'-disulphonate, disodium 4,4'-bis-(4-phenyl-2,1,3-triazol-2-yl)-stilbene-2,2'-disulphonate, disodium 4,4'-bis(2-anilino-4-(1-methyl-2-hydroxyethylamino)-s-triazin-6-yl-amino)stilbene-2,2'disulphonate and sodium 2(stilbyl-4''-(naphtho-1', 2':4,5)-1,2,3-trizole-2''-sulphonate.

In another preferred aspect of this invention, the laundry additive is comprised of a non-staining, antistatic fabric softening composition suitable for conditioning fabrics in automatic laundry dryer or during the last rinse cycle of a machine laundry operation. The like laundry additives conveniently comprise, deposited upon a substrate in addition to the amino-silane, an active textile softening ingredient selected from the group of cationic and/or nonionic fabric substantive agents. Examples of suitable cationic softening ingredients includes the species described in U.S. Pat. No. 4,128,484, column 5, line 52 to column 7, line 7, this passage being incorporated herein by reference. These softening ingredients have found widespread application in textile conditioning articles for use as pointed out above. The nonionic softening actives in addition to nonionic ethoxylates can be represented by fatty acid esters, paraffins, fatty alcohols and fatty acids. Also these classes of softening ingredients are well-known in the art and have found commercial application. Another class of suitable fabric softening agent is represented by the polyamines of European patent application No. 78-200059.0, page 4, line 37, to page 6, line 27, this passage being incorporated herein by reference.

Examples of preferred softening substrates in accordance with this invention, except for the amino-silanes, are disclosed in U.S. Pat. No. 4,103,047, this reference being incorporated herein by reference.

As an example, a laundry additive suitable for providing fabric softening within an automatic clothes dryer or within a washing machine comprises:

(a) a fabric softening amount of softening composition comprising:
  i. from about 10% to about 45% of the composition of a cationic fabric softener component, and
  ii. from about 50% to about 85% of the composition of a fatty alkyl sorbitan ester component selected from the group consisting of $C_{10}$ to $C_{26}$ fatty esters of sorbitan and ethoxylates of said esters wherein one or more of the unesterified —OH groups in said esters contain from 1 to about 6 oxyethylene moieties; and
  iii. from about 0.1% to about 5% of an amino-silane in accordance with claim 1; and (b) a flexible non-particulate substrate in sheet configuration, the fabric softener composition being releasably affixed on said substrate to provide a weight ratio of softener composition to dry substrate ranging from about 10:1 to about 0.5:1.

The preferred cationic softening agent is selected from the group consisting of the dialkyl dimethylammonium methyl sulfates wherein the alkyl groups are selected from tallowalkyl, stearyl, palmityl and behenyl, said softening agent being used in a level from 10% to 35% of the mixture of cationic and fatty alkyl sorbitan ester. The preferred sorbitan ester is selected from the group consisting of $C_{10}$–$C_{26}$ alkyl sorbitan monoesters and $C_{10}$–$C_{26}$ alkyl sorbitan diesters and mixtures thereof and more preferably comprises a mixture of sorbitan monostearate and sorbitan monopalmitate. The sorbitan ester component comprises from 89% to 10% of the mixture of cationic and sorbitan ester. Preferred amino-silanes for use in combination with a cationic softener containing laundry additive are those of claim 3.

EXAMPLE I

The following ingredients were processed as described in Example I of U.S. Pat. No. 4,220,562, columns 25 and 26 and deposited onto the substrate disclosed in that reference, column 26, lines 16–24.

The loading of the substrate was adjusted to provide on each sheet (the substrate weighed 2.8 g):

| INGREDIENT | COMPOSITION A | COMPOSITION I |
|---|---|---|
| Tetra acetyl ethylene diamine | 5 g. | 5 g. |
| $C_{14}$—$C_{15}$ oxo-alcohol with 7 moles of ethylene oxide per mole of alcohol | 5 g. | 5 g. |
| Polyethylene glycol 6000 | 5 g. | 5 g. |
| Copolymer of maleic anhydride and vinylmethylether (monomer ratio 1:1) | 0.3 g. | 0.3 g. |
| Ethylenediamine tetramethylene phosphonic acid | 0.5 g. | 0.5 g. |
| $C_{14}$—trimethylammonium bromide | 2.0 g. | 2.0 g. |
| N—(trimethoxysilylpropyl)-ethylene diamine | — | 0.1 g. |
| Miscellaneous inclusive of brightener, perfume and suds regulant (silicone) | 0.4 g. | 0.4 g. |

Laundry additives A (prior art) and I(this invention) were added in the beginning of the main-wash cycle together with 180 g. of commercial liquid detergent not containing alkaline/silicates. A boilwash (90° C.) laundry cycle was used. The washing machine was loaded with 3 kg. clean cotton and enamel-coated plates protected from physical contact with the machine surfaces but in contact with the laundry liquor. Enamel weight lossess were recorded and translated into a corrosion index (ECI) as follows:

$$\frac{\text{enamel weight loss observed with Composition I}}{\text{enamel weight loss observed with Reference Composition (A)}} \times 100 = ECI$$

The comparative results after 12 consecutive cycles were:

| COMPOSITION | ECI |
|---|---|
| A | 100 |

-continued

| COMPOSITION | ECI |
|---|---|
| I | 27 |

EXAMPLE II

A laundry additive (softening substrate) was prepared as described in Example I of U.S. Pat. No. 4,103,047, columns 17 and 18. 0.1 g. N-(trimethoxysilylpropyl)-ethylene diamine was sprayed onto each individual sheet.

Sheets so prepared are added to the rinse-step of a washing cycle carried out in an automatic washing machine. The sheets in accordance with this invention yield superior enamel protection.

Sheets so prepared can also be used effectively in a hot-air cloth dryer.

We claim:

1. A laundry additive product for inhibiting or preventing the corrosion of enamelled surfaces characterised in that it comprises a composition comprising an amino-silane having the formula $$(R_1O)_{3-x}-\overset{(R_1)_x}{\overset{|}{Si}}-(CH_2)_m-N(R_3)_2$$

where $R_1$ is $C_{1-4}$ alkyl or $C_{1-4}$ hydroxyalkyl x is 0 or 1 m is 1–6 each $R_3$ is H, R, $C_{1-6}$ alkylamine or $$\left[-(CH_2)_n-\overset{R_4}{\overset{|}{N}}-\right]_y-R_5$$

where $R_4$ is H or $R_1$ n is 1–6 y is 0–6

$R_5$ is $R_4$, $$(CH_2)_pC(=O)-OR_1 \text{ or } -C(=O)-NHR_4;$$

p is 1–6, the composition being impregnated in and/or coated on a flexible non particulate substrate, in a weight ratio of amino-silane to substrate of from 1:5,000 to 1:1.

2. A laundry additive in accordance with claim 1 wherein the substituents of the amino-silane are as follows:

$R_1$=—$CH_3$ or —$C_2H_5$, x=O m=2 or 3

$R_3$=hydrogen and $$\left[-(CH_2)_{2-3}-\overset{R_4}{\overset{|}{N}}-\right]_{1-2}-R_5$$

$R_4$=hydrogen or methyl $R_5$=hydrogen or methyl.

3. A laundry additive in accordance with claims 1 or 2 wherein the amino-silane is selected from:

$$(CH_3-O)_3-Si-(CH_2)_3-NH-(CH_2)_2-NH_2$$

$$(CH_3-O)_3-Si-(CH_2)_3-NH-(CH_2)_3-NH_2$$

$$(CH_3-O)_3-Si-(CH_2)_3-NH-(CH_2)_2-NH(CH_2)_2NH_2.$$

4. A laundry additive product dependent on claim 1 further comprising a solid water soluble or water dispersant organic adjuvant having softening point greater than 40° C. and a melting point less than 80° C., the weight ratio of the amino-silane to the adjuvant being in the range 20:1 to 1:3.

5. A laundry additive product dependent on claim 4 wherein the organic adjuvant is selected from $C_{12}$–$C_{18}$ alcohols containing from 15–80 ethylene oxide groups per mole of alcohol, $C_{12}$–$C_{18}$ fatty acids and their esters and amides, and polyethylene glycols of Mwt.>4000.

6. A laundry additive product dependent on claim 1 further comprising a surfactant which is a condensation product of an alkylene oxide and an organic hydrophobic residue having a reactive hydrogen atom, the surfactant having an HLB in the range 8.0–17.0.

7. A laundry additive product dependent on claim 6 wherein the surfactant is a substantially linear alcohol ethoxylate containing from seven to twenty ethylene oxide groups per mole of alcohol.

8. A laundry additive product dependent on claim 1 further comprising a polybasic acid selected from the group consisting of citric acid, nitrilotriacetic acid, ethylene diamine tetra acetic acid, substituted and unsubstituted alkylene and amino alkylene phosphonic acids, succinic acid and glutaric acid and their alkali metal and ammonium salts present in such an amount that the polybasic acid:substrate weight ratio lies in the range 5:1 to 1:20.

9. A laundry additive product dependent on claim 1 further comprising an organic peroxy compound precursor selected from $C_1$–$C_8$ aliphatic acyl imides, aryl acyl imides, N-substituted derivatives thereof, and phenol esters of aliphatic or aromatic mono and dicarboxylic acids in which the acyl radical or radicals contain a $C_1$–$C_8$ alkyl group.

10. A laundry additive in accordance with claim 1, capable of providing fabric softening within an automatic clothes dryer or washing machine comprising:

(a) a fabric softening amount of softening composition comprising:

i. from about 10% to about 89% by weight of the composition of cationic fabric softener component, and ii. from about 10% to about 90% by weight of the composition of a fatty alkyl sorbitan ester component selected from the group consisting of $C_{10}$ to $C_{26}$ fatty esters of sorbitan and ethoxylates of said esters wherein one or more of the unesterified —OH groups in said esters contain from 1 to about 6 oxyethylene moieties; and iii. from about 0.1% to about 5% by weight of an amino-silane in accordance with claim 1; and (b) a flexible non-particulate substrate in sheet configuration, the fabric softener composition being releasably affixed on said substrate to provide a weight ratio of softener composition to dry substrate ranging from about 10:1 to about 0.5:1.

11. A laundry additive in accordance with claim 10 wherein the cationic softening agent is selected from the group of dialkyl dimethylammonium methylsulfate wherein the alkyl group can represent: tallowalkyl, stearyl, palmityl and behenyl, and the sorbitan ester comprises a mixture of sorbitan monostearate and sorbitan monopalmitate.

* * * * *